US005255888A

United States Patent [19]

Workman

[11] Patent Number: 5,255,888

[45] Date of Patent: Oct. 26, 1993

[54] CONCRETE COLUMN FORM

[75] Inventor: Gary Workman, Lombard, Ill.

[73] Assignee: Deslauriers, Inc., Bellwood, Ill.

[21] Appl. No.: 712,045

[22] Filed: Jun. 7, 1991

[51] Int. Cl.[5] ..... E04G 13/02

[52] U.S. Cl. ..... 249/48; 249/165; 249/168; 249/192

[58] Field of Search ..... 249/48, 51, 160, 163, 249/165, 168, 169, 192, 194, 196

[56] References Cited

U.S. PATENT DOCUMENTS

| | | | |
|---|---|---|---|
| 840,637 | 1/1907 | Locher | 249/48 |
| 1,168,147 | 1/1916 | Bender | 249/48 |
| 1,220,083 | 3/1917 | Fouse | 249/48 |
| 1,282,200 | 10/1918 | Des Lauriers | 249/48 |
| 1,947,413 | 2/1934 | Hay | 249/48 |
| 2,448,883 | 9/1948 | Hall | 249/48 |
| 3,021,586 | 2/1962 | Uruburu | 249/48 |
| 3,596,870 | 8/1971 | Walker | 249/165 |
| 3,815,851 | 6/1974 | Girard | 249/163 |
| 4,171,791 | 10/1979 | Britz | 249/168 |

OTHER PUBLICATIONS

Deslauriers, Inc. Form No. L106.
Deslauriers, Inc. Form No. L110.
Decra-Glass brochure, copyright 1975.
MFG Concrete Forms Company, designated 3.5/Mo.
Universal Form Clamp Form 3.5/Un.

*Primary Examiner*—Jay H. Woo
*Assistant Examiner*—James P. Mackey
*Attorney, Agent, or Firm*—Wood, Phillips, VanSanten, Hoffman & Ertel

[57] ABSTRACT

A concrete column form includes a plurality of half-round sections secured together by a plurality of bolts. Each section comprises a semi-cylindrical wall having a top edge, a bottom edge and opposite side edges. A semi-circular top flange is connected to and extends radially outwardly from the top edge, including a semi-circular raised ridge extending upwardly therefrom and a plurality of apertures therethrough. A semi-circular bottom flange is connected to and extends radially outwardly from the bottom edge and includes a semicircular indented notch opening downwardly therefrom for receiving the raised ridge from the top flange of a subjacent section for aligning the same and a plurality of apertures therethrough circumferentially aligned with the top flange apertures for receiving the bolts to fasten the same to the top flange of a subjacent section. A pair of side flanges are provided, one each connected to and extending radially outwardly from one of the side edges between the top flange and the bottom flange, each side flange including a plurality of aligned apertures therethrough for receiving the bolts to fasten the same to one side flange of an adjacent section to form a cylindrical column form.

5 Claims, 2 Drawing Sheets

CONCRETE COLUMN FORM

FIELD OF THE INVENTION

This invention relates to concrete column forms and, more particularly, to a form made of stackable, plastic sections.

BACKGROUND OF THE INVENTION

In order to construct concrete columns, piers and footings it is generally necessary to utilize a concrete form. The form acts as a mold for pouring concrete to provide a desired size and shape. Among available forms are fiber forms, steel sectional forms and fiberglass forms. Fiber forms are generally single-piece cylindrical forms of a select diameter. The form can be cut to length on a job site, erected, braced and stripped quickly and easily. As such, these forms are not reusable. Also, the fiber forms are less desirable when used in wet areas and must be slit along the side if used around a steel column, resulting in loss of strength.

Steel forms generally comprise half round sections bolted into units. Each section comprises a semi-cylindrical wall framed with flange angles die cut and punched for flush butt joints. Vertical and horizontal seams are connected with bolts. A plurality of similar or different length sections can be stacked together according to the necessary column height. Some of the problems with steel sectional forms including heavy weight, expense to produce and the possibility of rusting of the steel. Also, grout leakage can occur where the flanges abut, degrading appearance.

Fiberglass forms have also been used in half-round sections, as with steel form sections. However, such fiberglass sections lack uniformity in wall and flange thickness and do not stack as well. Further, flanges require steel backing where bolts are used for securing sections together. One known form of such fiberglass forms utilize interlocking tongue and groove vertical flanges to minimize vertical seams in the concrete columns. However, problems still remain owing to possible horizontal seams.

The present invention is directed to overcoming one or more of the problems discussed above in a novel and simple manner.

SUMMARY OF THE INVENTION

It is an object of the invention to provide an injection molded plastic column form section.

It is another object of the invention to provide a column form section including interlocking flanges on all sides.

It is still another object of the invention to eliminate the requirement for steel backup for bolting flanges together.

It is yet another object of the invention to provide adjustability in a lightweight form.

It is still a further object of the invention to provide a self-adjusting and aligning column form.

It is yet a further object of the invention to provide a column form adapted to mate with fiber tubes.

It is still another object of the invention to provide a plastic column form adaptable to be used with steel form sections.

It is still a further object of the invention to provide an inexpensive column form.

It is still an additional object of the invention to provide a reusable column form section.

Broadly, there is disclosed herein a concrete column form including a plurality of half-round sections secured together by a plurality of bolts. Each section comprises a semi-cylindrical wall having a top edge, a bottom edge and opposite side edges. A semi-circular top flange is connected to and extends radially outwardly from the top edge, including a semi-circular raised ridge extending upwardly therefrom and a plurality of apertures therethrough. A semi-circular bottom flange is connected to and extends radially outwardly from the bottom edge and includes a semi-circular indented notch opening downwardly therefrom for receiving the raised ridge from the top flange of a subjacent section for aligning the same and a plurality of apertures therethrough circumferentially aligned with the top flange apertures for receiving the bolts to fasten the same to the top flange of a subjacent section. A pair of side flanges are provided, one each connected to and extending radially outwardly from one of the side edges between the top flange and the bottom flange, each side flange including a plurality of aligned apertures therethrough for receiving the bolts to fasten the same to one side flange of an adjacent section to form a cylindrical column form.

It is a feature of the invention that the section comprises a plastic section of unitary construction.

It is another feature of the invention that the section comprises a section of injection molded plastic.

It is a further feature of the invention that each section further comprises a raised circular ridge surrounding each said aperture through the side flange.

It is yet another feature of the invention that each section further comprises an elongate raised ridge extending from one of the side flanges between the top and bottom flanges and facing one side flange of the adjacent section and the other side flange includes an elongate indented notch between the top and bottom flanges and facing another side flange of the adjacent section for receiving a raised ridge from such other side flange.

Further features and advantages of the invention will readily be apparent from the specification and from the drawings.

DETAILED DESCRIPTION OF THE INVENTION

With reference to FIGS. 1–8, a plastic column form 10 is illustrated for molding a smooth, hard surface concrete column free of voids and seams. The form 10 is assembled of injection molded plastic half round sections 12 and 14 bolted into units for handling on a job site. The sections 12 and 14 are virtually identical other than being of different heights. Particularly, the sections can be provided in any select radius and height with units of equal radius being joined side-by-side and in a stacked configuration to provide a concrete column mold of virtually any desired length. For example, the sections may be provided to provide any number of column diameters from twelve inches to eighty-four inches and eight foot, four foot, two foot and one foot lengths.

Figure 7:
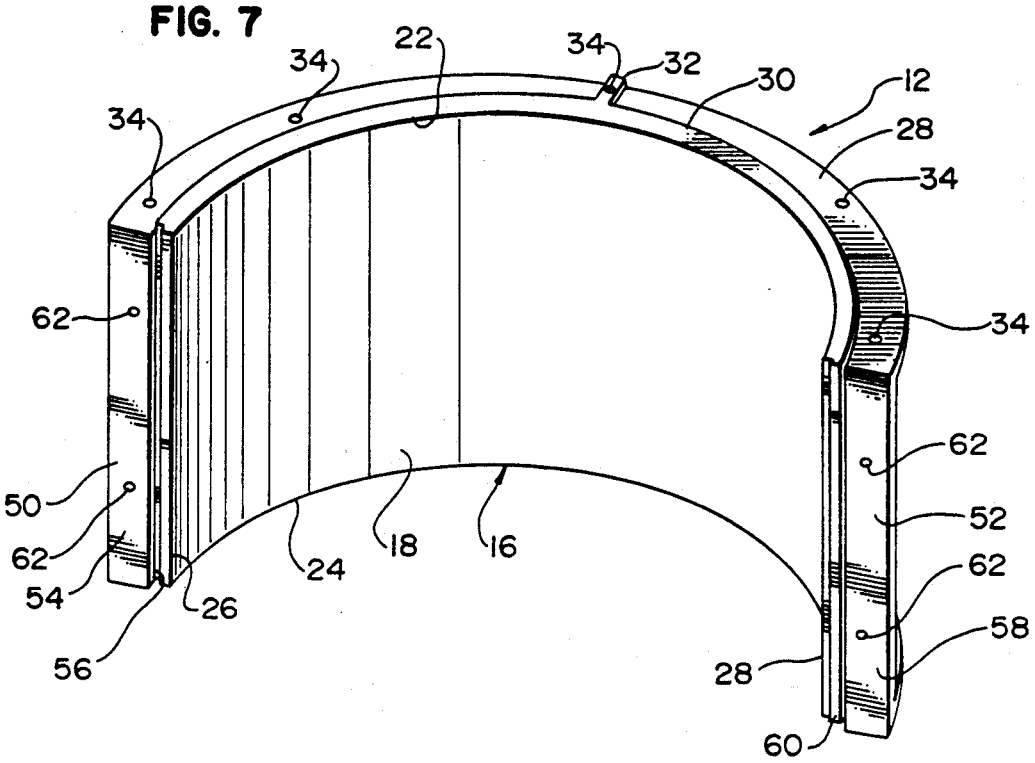
FIG. 7 is a perspective view particularly illustrating the inside and top portion of the form section according to the invention.
Figure 8:
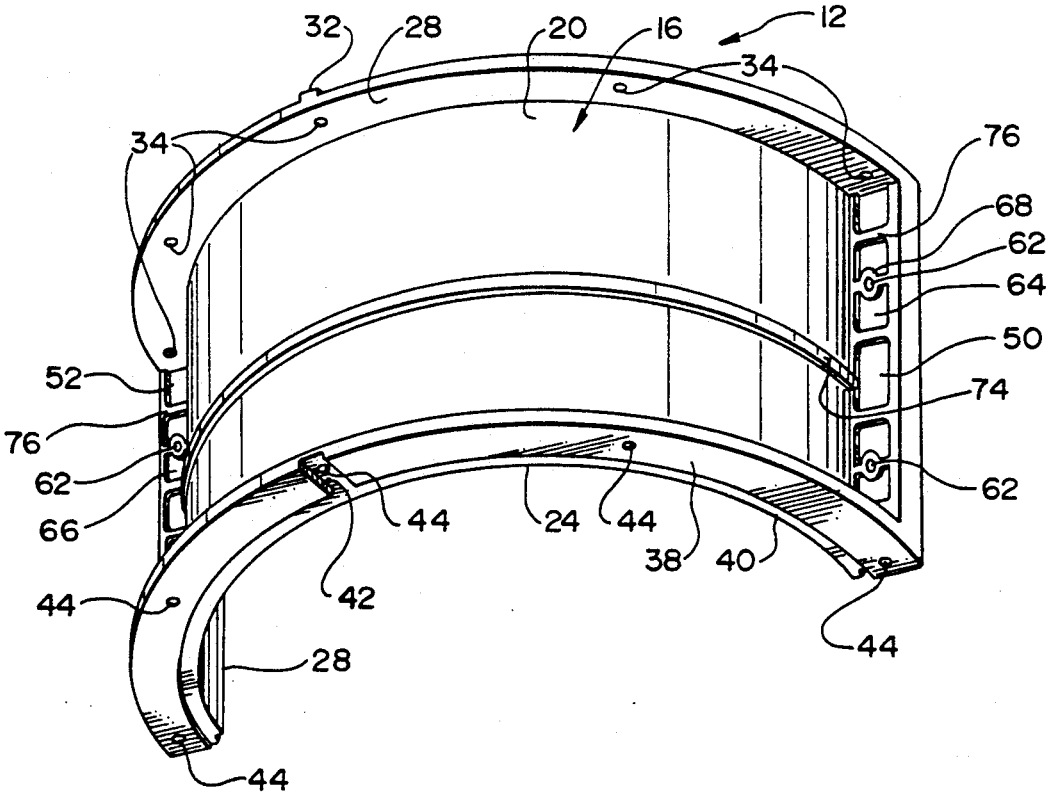
FIG. 8 is a perspective view particularly illustrating the outer and bottom portion of the form section according to the invention.

With particular reference to FIGS. 7 and 8, each section 12 includes a semi-cylindrical wall 16 defining an inside surface 18 and an outside surface 20. The inside surface 18 may be generally smooth or sculpted according to the desired outer surface of the concrete column. The wall 16 includes a top edge 22, a bottom edge 24 and opposite side edges 26 and 28.

A semi-circular top flange 28 is connected to and extends radially outwardly from the top edge 22. The top flange 28 is generally planar and includes a semi-circular raised ridge 30 extending upwardly therefrom. The wall top edge 22 defines an inner radius of the ridge 30. A radially extending raised ridge 32 extends upwardly from the flange 28 radially outwardly of the semi-circular ridge 30. The ridges 30 and 32 are of equal height. The ridge 32 is circumferentially spaced midway between the wall side edges 26 and 28. A plurality of apertures 34 extend through the flange 28.

A semi-circular bottom flange 38 is connected to and extend radially outwardly from the bottom edge 24. The bottom flange 38 is generally planar and includes a semi-circular indented notch 40 opening downwardly therefrom. The wall bottom edge 24 defines an inner radius of the notch 40. A radially extending indented notch 42 opens downwardly from the flange 38 radially outwardly of the semi-circular notch 40. The notches 40 and 42 are of equal depth, which such depth is substantially equal to the height of the ridges 30 and 32. The notch 42 is circumferentially spaced midway between the wall side edges 26 and 28. A plurality of apertures 34 extend through the flange 38.

Figure 2:
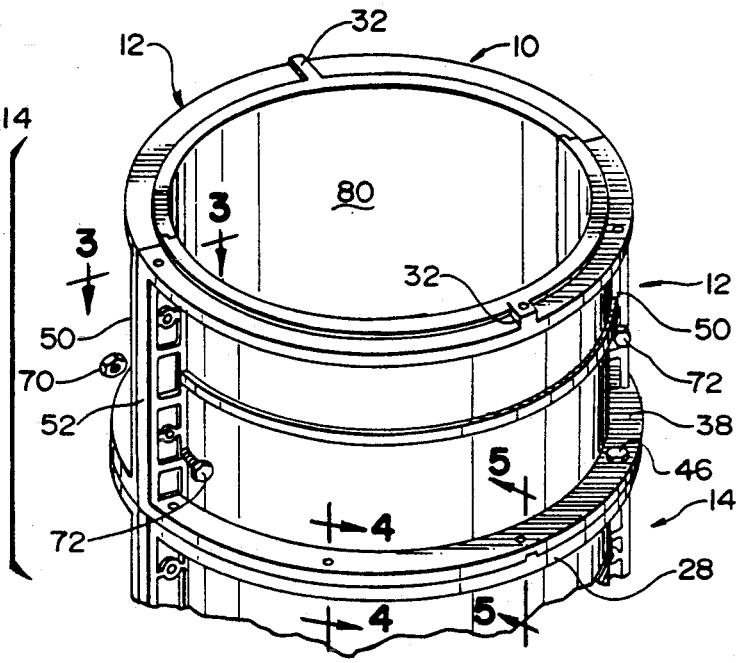
FIG. 2 is a perspective view of a top portion of the column form of FIG. 1.

The bottom flange apertures 44 are circumferentially aligned with the top flange apertures 34. When stacking sections 12, or 12 and 14, the bottom flange 38 of one section is placed atop the top flange 28 of another section with the semi-circular notch 40 receiving the semi-circular raised ridge 30 of the subjacent section, see FIG. 4. This interlocking structure virtually eliminates horizontal seams in the formed concrete column. Also, the radially extending notch 42 receives the radially extending raised ridge 32 of a subjacent section, see FIG. 5, to provide circumferential self-alignment of the sections. Bolts 46, see FIG. 2, are inserted through aligned apertures 34 and 44 for securing the top and bottom sections together.

To fasten a pair of sections 12 at a given vertical height, each section includes a pair of opposite side flanges 50 and 52 connected to and extending radially outwardly from the opposite side edges 26 and 28, respectively. Each side flange 50 and 52 extends between and is connected to the top flange 28 and the bottom flange 38. The first side flange 50 includes a generally smooth inner surface 54 having an elongate indented notch 56 extending between said top flange 28 and bottom flange 38. An outer edge of the notch 56 corresponds to an outer edge of the bottom flange notch 40, see FIG. 8. The second side flange 52 includes a generally planar inner surface 58 having an elongate raised ridge 60 extending from the top flange 28 to the bottom flange 38. An outer edge of the raised ridge 60 is aligned with an outer edge of the top flange raised ridge 30, see FIG. 7. Each side flange 50 and 52 includes a plurality of apertures 62 therethrough. An outer surface 64 and 66 of each respective side flange 50 and 52 includes a circular raised ridge 68 surrounding each aperture 62.

Figure 3:
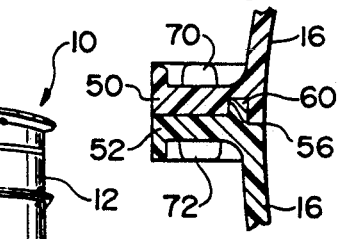
FIG. 3 is a sectional view taken along the line 3—3 of FIG. 2.
Figure 4:
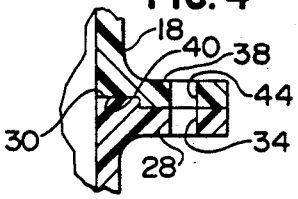
FIG. 4 is a sectional view taken along the line 4—4 of FIG. 2.
Figure 5:
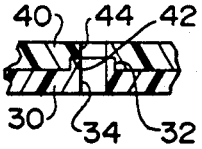
FIG. 5 is a sectional view taken along the line 5—5 of FIG. 2.

To horizontally fasten a pair of sections together, the two half-round sections are positioned at an equal vertical height with the ridge 60 of each second flange 52 received in the notch 56 of the first flange of the mated section, see FIG. 3. The interlocking of the ridge 60 and notch 56 virtually eliminates a vertical seam in the formed concrete column. A plurality of nuts 70 and bolts 72 are inserted through aligned apertures 62 for fastening the sections 12 together.

Horizontally fastened sections can then be fastened vertically to provide a desired length column.

A semi-circular raised rib 74 is provided on the wall outer surface 20 midway between the top flange 28 and bottom flange 38 to provide strength and rigidity. Each side flange 50 and 52 also includes a ribbed matrix 76 for the same purpose.

The bottom flange notch 40 can also be used to mate with a fiber form. Particularly, if part of a column is below ground, then the fiber form can be used below ground with a top edge of the same received in the notch 40 of above ground sections 12.

In accordance with the invention, each section 12 or 14 comprises a plastic section formed using injection molding of suitable resins. Doing so provides a lightweight, relative inexpensive and reusable section for building concrete forms. Such a form is suitable for use in wet areas and can be readily assembled to surround steel columns and the like without loss of strength. Further, in pier applications the sections 12 can be used without fear of rust and the like from salt water. Moreover, owing to the use of the interlocking notches and grooves along each adjoining seam, as well as the alignment ridge and notches, the sections are self-aligning and self-sealing to provide a more desirable appearance. The self-aligning feature allows the sections to be assembled with one another more quickly.

Injection molding permits the sections to be of unitary construction including the side wall 16, top and bottom flange 28 and 38 respectively, and the side flanges 50 and 52. However, due to difficulties with molding, the apertures 34 and 44 in the top and bottom flanges 28 and 38, respectively, must be drilled separately.

Figure 1:
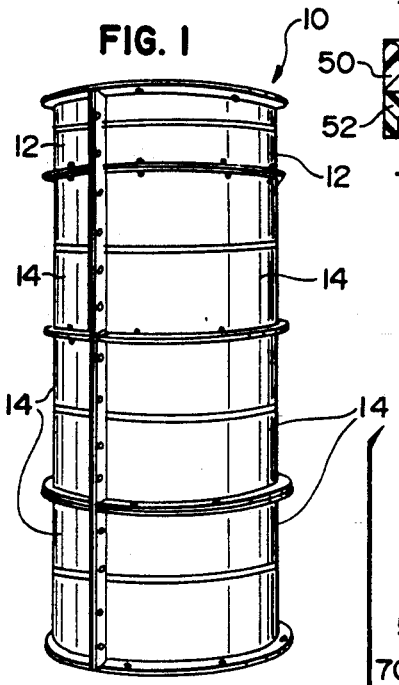
FIG. 1 is a perspective view of an assembled concrete column form utilizing sections according to the invention.
Figure 6:
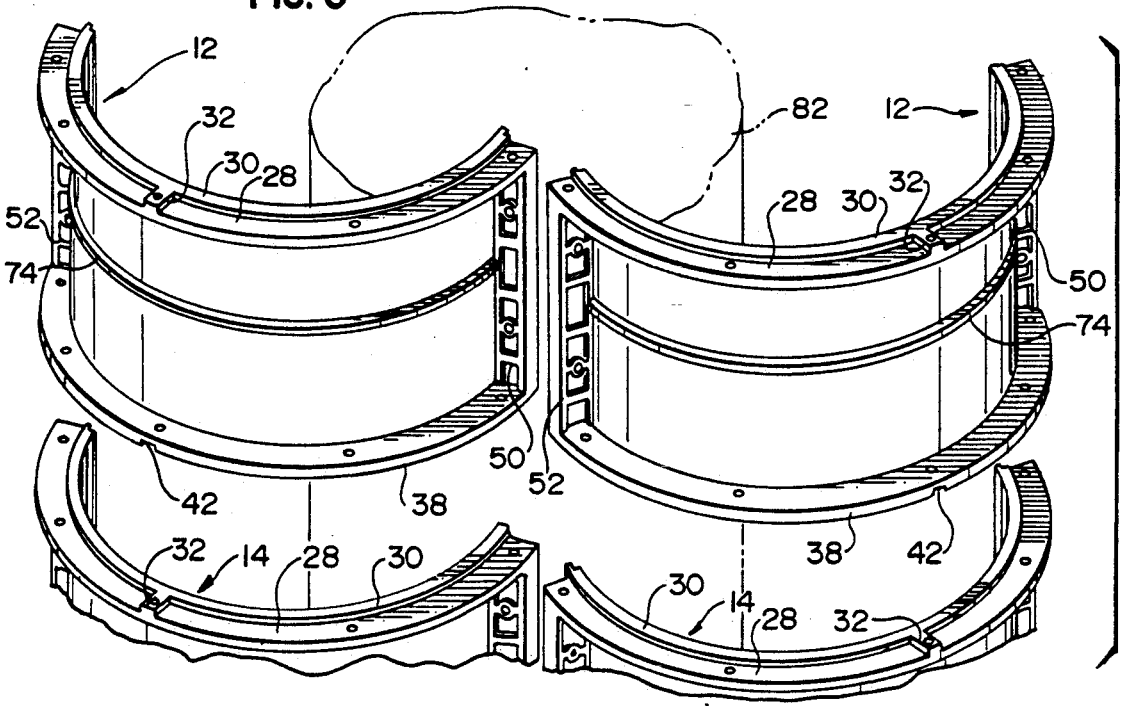
FIG. 6 is an exploded view showing the sections of the form of FIG. 2 being removed after molding a concrete column.

Thus, with a concrete column 10, such as illustrated in FIGS. 1 and 2, a cylindrical interior space 80 is provided which can be filled with concrete to construct a column 82, see FIG. 6. Thereafter, the sections 12 and 14 can be disassembled as illustrated in FIG. 6 and subsequently reused. The use of the semi-cylindrical construction of each section allows the same to be easily stacked with one another to facilitate storage.

Thus, in accordance with the invention, there is provided a inexpensive, reusable and lightweight mold form section.

I claim:

1. A concrete column form including a plurality of self-aligning, half-round sections secured together by a plurality of bolts, each said section comprising:

a semi-cylindrical wall having a top edge, a bottom edge and opposite side edges;

a semi-circular top flange connected to and extending radially outwardly from said top edge, including a semi-circular raised ridge and a radially extending raised ridge extending upwardly therefrom and a plurality of apertures therethrough;

a semi-circular bottom flange connected to and extending radially outwardly from said bottom edge and including a semicircular indented notch and a radially extending indented notch opening downwardly therefrom for receiving the raised ridges from the top flange of a subjacent section for aligning the same and a plurality of apertures therethrough circumferentially aligned with said top flange apertures for receiving said bolts to fasten the same to the top flange of said subjacent section; and a pair of side flanges each connected to and extending radially outwardly from a respective one of said side edges between said top flange and said bottom flange, each said side flange including a plurality of aligned apertures therethrough for receiving said bolts to fasten the same to one side flange of an adjacent section to form a cylindrical column form.

2. The concrete column form of claim 1 wherein each said section is formed of plastic and is of unitary construction.

3. The concrete column form of claim 1 wherein each said section is formed of injection molded plastic.

4. The concrete column form of claim 1 wherein each said section further comprises a raised circular ridge surrounding each said aperture through at least one of said side flanges.

5. The concrete column form of claim 1 wherein each said section further comprises an elongate raised ridge extending from one of said side flanges between said top and bottom flanges and facing one side flange of an adjacent section and the other side flange includes an elongate indented notch between said top and bottom flanges and facing another side flange of said adjacent section for receiving the raised ridge from said other side flange.

* * * * *